US006425701B1

(12) United States Patent
Jacobs

(10) Patent No.: US 6,425,701 B1
(45) Date of Patent: Jul. 30, 2002

(54) LIQUID DISPENSING HANDLE

(75) Inventor: Neal Kenneth Jacobs, Carmel, IN (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 09/511,250

(22) Filed: Feb. 23, 2000

(51) Int. Cl.[7] ..... A46B 11/04

(52) U.S. Cl. ..... 401/6; 401/206; 401/207; 401/279; 401/290

(58) Field of Search ..... 401/6, 205–207, 401/270, 272, 273, 278, 279, 289, 290

(56) References Cited

U.S. PATENT DOCUMENTS

| | | | | | |
|---|---|---|---|---|---|
| 838,241 | A | | 12/1906 | Conners | |
| 1,067,780 | A | * | 7/1913 | Brink | 401/279 |
| 1,329,944 | A | | 2/1920 | Williams | |
| 1,620,801 | A | | 3/1927 | Clark | 401/207 |
| 2,742,660 | A | | 4/1956 | Van Esley | 15/138 |
| 2,772,430 | A | | 12/1956 | Moritt | 15/133 |
| 2,820,234 | A | | 1/1958 | Rigney | 15/136 |
| 2,952,026 | A | | 9/1960 | Pland | 15/131 |
| 3,128,493 | A | | 4/1964 | Paul | 15/542 |
| 3,690,779 | A | | 9/1972 | Ellis | 401/266 |
| 4,008,968 | A | | 2/1977 | Hobbs | 401/207 |
| 4,127,911 | A | | 12/1978 | Cupp et al. | 15/210 R |
| 4,148,318 | A | | 4/1979 | Meyer | 128/269 |
| 4,183,684 | A | | 1/1980 | Avery, Jr. | 401/133 |
| 4,244,075 | A | | 1/1981 | Silver | 15/145 |
| 4,552,476 | A | | 11/1985 | Heraty et al. | 401/136 |
| 4,609,301 | A | | 9/1986 | Benarrouch | 401/196 |
| 4,747,720 | A | | 5/1988 | Bellehumeur et al. | 401/205 |
| 4,826,340 | A | | 5/1989 | Rothweiler et al. | 401/279 |
| 4,875,602 | A | | 10/1989 | Chickering et al. | 222/187 |
| 4,886,388 | A | | 12/1989 | Gulker et al. | 401/148 |
| 4,934,855 | A | | 6/1990 | Recchelbacher | 401/137 |
| 4,961,662 | A | | 10/1990 | Chow et al. | 401/42 |
| 5,114,255 | A | | 5/1992 | Villarreal | 401/45 |
| D330,788 | S | | 11/1992 | Berti | D32/45 |
| 5,213,430 | A | | 5/1993 | Pandola | 401/137 |
| 5,214,820 | A | | 6/1993 | Shumway et al. | 15/118 |
| D344,635 | S | | 3/1994 | Berti | D4/138 |
| 5,336,330 | A | | 8/1994 | Shumway et al. | 134/8 |
| D351,066 | S | | 10/1994 | Libman | D4/199 |
| 5,371,917 | A | | 12/1994 | Hoagland | 15/244.1 |
| 5,454,659 | A | | 10/1995 | Vosbikian et al. | 401/207 |
| D376,262 | S | | 12/1996 | Ancona et al. | D4/138 |
| D382,409 | S | | 8/1997 | Berti | D4/138 |
| D387,704 | S | | 12/1997 | Berti | D4/114 |
| D389,652 | S | | 1/1998 | Berti | D4/138 |
| 6,099,184 | A | * | 8/2000 | Koptis | 401/190 |

* cited by examiner

*Primary Examiner*—Gregory L. Huson
*Assistant Examiner*—Peter deVore
(74) *Attorney, Agent, or Firm*—Marshall, Gerstein & Borun.

(57) ABSTRACT

A dispensing handle applicator (10) is disclosed comprising a handle housing (16) having an internal fluid reservoir (68) and a through- passageway (94) through which fluid may be dispensed; and a base plate member (14) having an applicator surface (12) on one side and attachable at an opposite side to the handle housing. Integrally formed with the base plate member (14) is a valve comprising a lever (42) and a plurality of torsion spring members (58, 60) which pressure a sealing end (48) of the lever (42) against the handle housing (16), whereby sealing the fluid passageway (94). A scraping element (62) is further provided, integrally formed with the base plate (14) and replaceable therewith.

31 Claims, 5 Drawing Sheets

LIQUID DISPENSING HANDLE

BACKGROUND OF THE INVENTION

1. Field of the Invention

The present invention relates to handled cleaning implements in general, and specifically to such implements having a cleaning liquid dispensing handle and a cleaning pad disposed at an end of the handle for receiving cleaning liquid dispensed therefrom.

2. The Prior Art

Handled cleaning implements are well known and commonly used household cleaning aids. Such implements typically comprise a gripping handle portion at one end and a cleaning pad or sponge mounted to an opposite end. The user grips the device by the handle and cleans a surface by means of the sponge end. A scraping blade is typically provided at a forward end to assist the user in certain cleaning tasks.

A useful enhancement to the conventional cleaning implement has been the development of a dispensing handle having an internal reservoir for the storage of liquid cleanser. The dispensing handle provides a through passageway at the remote sponge end through which the stored liquid cleanser is dispensed under the influence of gravity into the sponge member. The liquid cleanser can thereby be supplied continuously to the sponge and therefrom to any surface in contact with the sponge.

While the liquid dispensing handled implement described above represents an improvement over traditional devices, a serious shortcoming is that the discharge of liquid cleanser is continuous and unregulated. Consequently, it is typical that more liquid than is necessary becomes deposited on the sponge and is wasted. A second shortcoming is that the connection between the sponge member and the handle is not liquid tight, and leakage of the liquid can occur between the components. The result, again, is wasted cleaning liquid.

To solve the above deficiencies, improved liquid dispensing handled implements have been devised for regulating the quantity of liquid cleaner dispensed from the handle reservoir and for sealing the connection between the sponge and the handle member. U.S. Pat. Nos. 4,826,340 and 5,454,659 are representative of such improvements. The device in U.S. Pat. No. 5,454,659 comprises a handle and a sponge applicator. The handle includes a nipple at one end having a pinhole opening through which liquid flows from the handle reservoir. The sponge applicator attaches to the handle to form a liquid tight seal between the applicator and the outside circumference of the handle, and between the nipple and an opening in the support piece of the applicator. Excess liquid is thereby directed without leakage through the nipple and into the sponge. While this configuration prevents waste from escaping liquid, it does not allow the user to efficiently regulate the quantity of cleaning liquid is dispensed from the handle into the sponge member.

U.S. Pat. No. 5,454,659 provides a mechanism for controlling or regulating the volume of liquid discharged from the handle. The brush comprises a two housing halves, a brush body, and a valve member. The housing is formed as two symmetrically configured halves are attached and define therebetween a reservoir. The valve member is assembled within a groove of one half housing member and encaptured therein as the second half housing is attached to the first housing half. The valve is actuated by a slide mechanism to open and close an aperture in a lower portion of the housing member, whereby controlling the flow of liquid from the housing onto the brush body.

While the mechanism of U.S. Pat. No. 5,454,659 functions as intended to control the flow of liquid between the handle housing and the brush body, several deficiencies remain. First, four components are required, adding to the cost of manufacture. Moreover, the assembly of the four components is labor intensive and, accordingly, costly. Secondly, the assembly of the components is complicated by the requirement that the valve member be mounted within the reservoir of the handle housing. In addition, the handle housing itself is of relatively thick walled construction, necessitated by the functional demands thereon in housing and supporting the valve member, and by the functional provision of a scraping blade element at a forward end. The additional strength required in the handle housing, again, adds undesirable cost to the device. Finally, repair or replacement of the valve component is extremely difficult or impossible because the valve assembly is configured to house the valve element between the handle halves. In order to access the valve member, destruction of the handle would be necessary.

SUMMARY OF THE INVENTION

The present invention overcomes the aforementioned deficiencies in the prior art applicator devices by providing a two component assembly comprising a handle housing and an applicator attachment. The handle housing is formed of thin-walled plastic construction and includes an internal liquid reservoir and a discharge opening at a working end for allowing liquid to exit the reservoir. The applicator attachment comprises a molded plastic base plate of relatively thicker wall construction which releasably attaches to the handle housing. An applicator element, preferably a sponge or a plurality of brush bristles are affixed to one surface of the applicator attachment.

Integrally formed with the applicator attachment base plate is a valve member, comprising a molded plastic lever member and a molded plastic torsion spring. The lever member includes. a first forward extending arm having a stopper attached at a remote end, a second rearward extending arm, and a fulcrum portion between the first and second lever arms. The torsion spring is configured as a plastic arm supported at opposite ends by the base plate and a suspended mid-portion extending between the supported opposite ends. The fulcrum portion of the lever is pivotally attached to the mid-portion of the torsion spring and the lever member pivots between an unbiased first position in which the stopper is positioned away from the discharge opening and a biased second position in which the stopper is biased against the handle housing in sealing relationship to the discharge opening.

The applicator attachment base plate, valve member, and torsion spring are integrally formed as a one-piece unit, eliminating the need for assembly and resulting in economies of manufacture. The handle housing is molded as a one-piece unit and of thin-walled construction to conserve material. A scraping element is formed in the applicator attachment base plate at a forward end. The applicator attachment is releasably secured to the handle housing and can be removed and readily replace the attachment with another.

The lever member is digitally actuated to reliably seal the discharge opening in the handle housing, whereby giving the user control over the quantity of cleaning liquid discharged from the handle reservoir.

Accordingly, it is an objective of the subject invention to provide a liquid applicator implement having reliable means for controlling the quantity of liquid discharged.

A further objective of the invention is to provide a liquid applicator implement which has a minimal assembly requirement.

Still another objective is to provide a liquid applicator which provides a scraper element at a forward end.

Yet a further objective is to provide a liquid applicator which is readily refilled.

An additional objective is to provide a liquid applicator having minimal leakage.

A further objective is to provide a liquid applicator comprising a minimal number of component parts which individually are economically and readily manufactured, and which are economically and readily assembled.

These, and other objectives, which will be appreciated by one skilled in the art, are achieved by a preferred embodiment which is described in detail below and illustrated in the accompanying drawings.

DESCRIPTION OF THE PREFERRED EMBODIMENT

Figure 1:
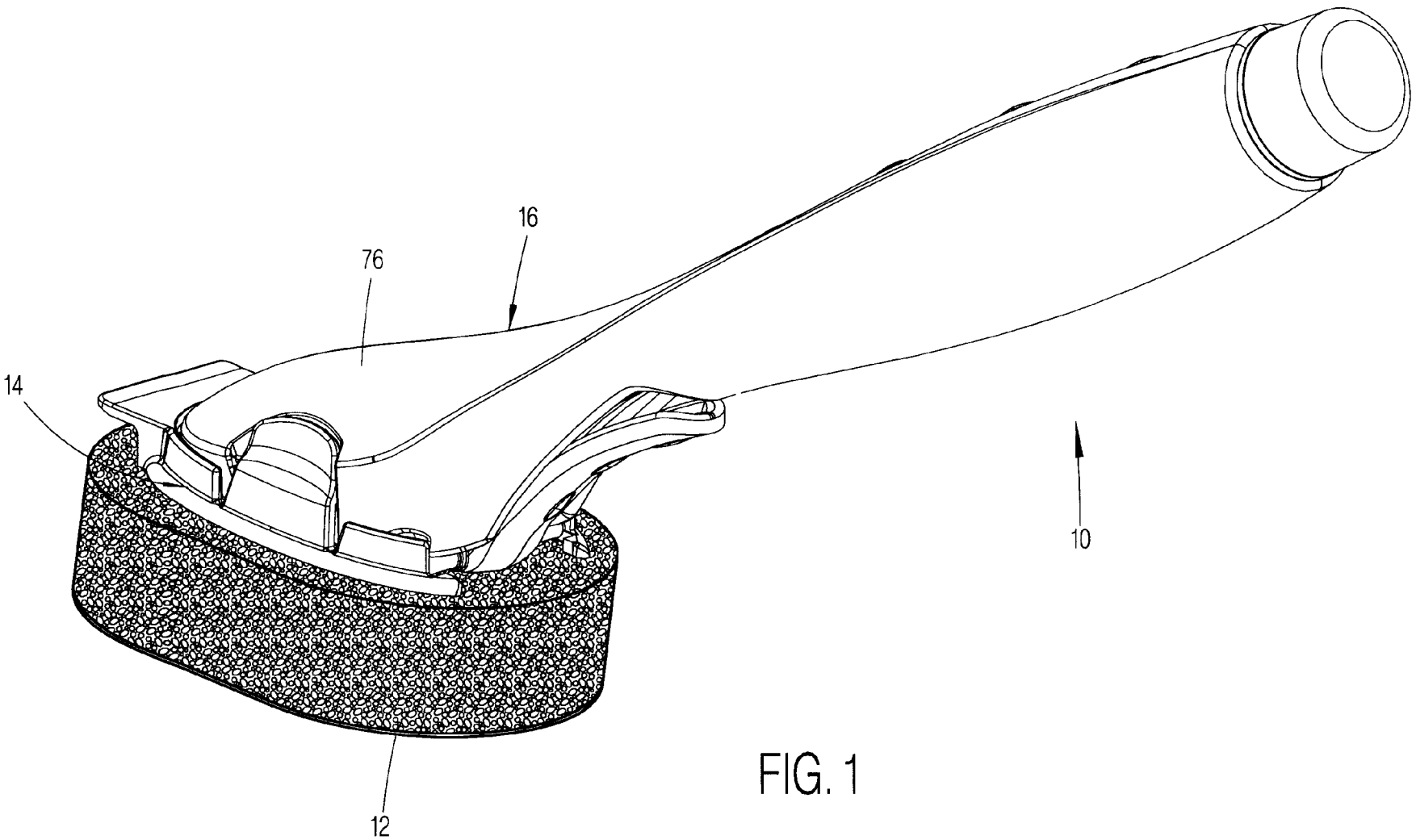
FIG. 1 is a top rear perspective view of the subject liquid dispensing handle.
Figure 2:
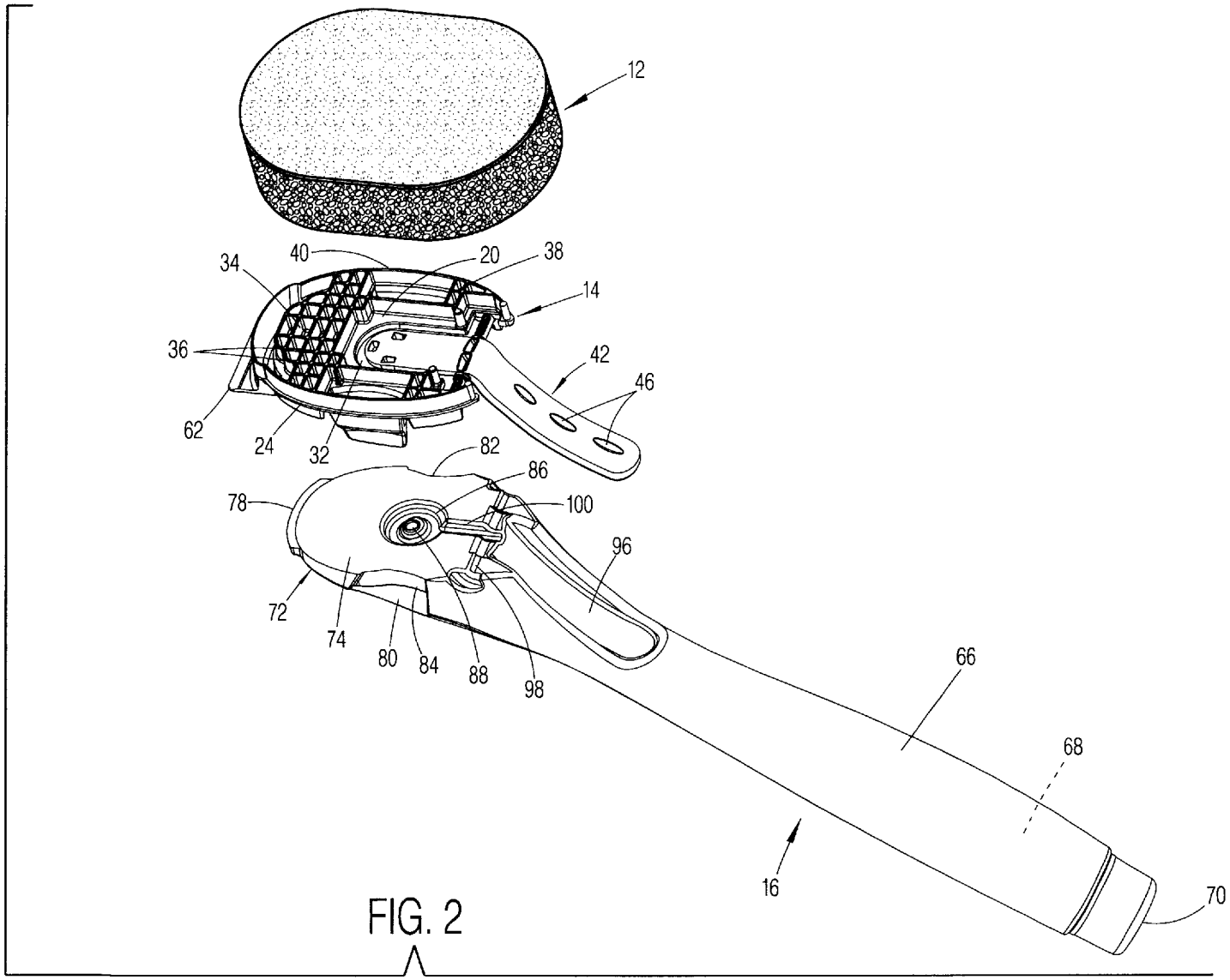
FIG. 2 is an exploded perspective view thereof.
Figure 3:
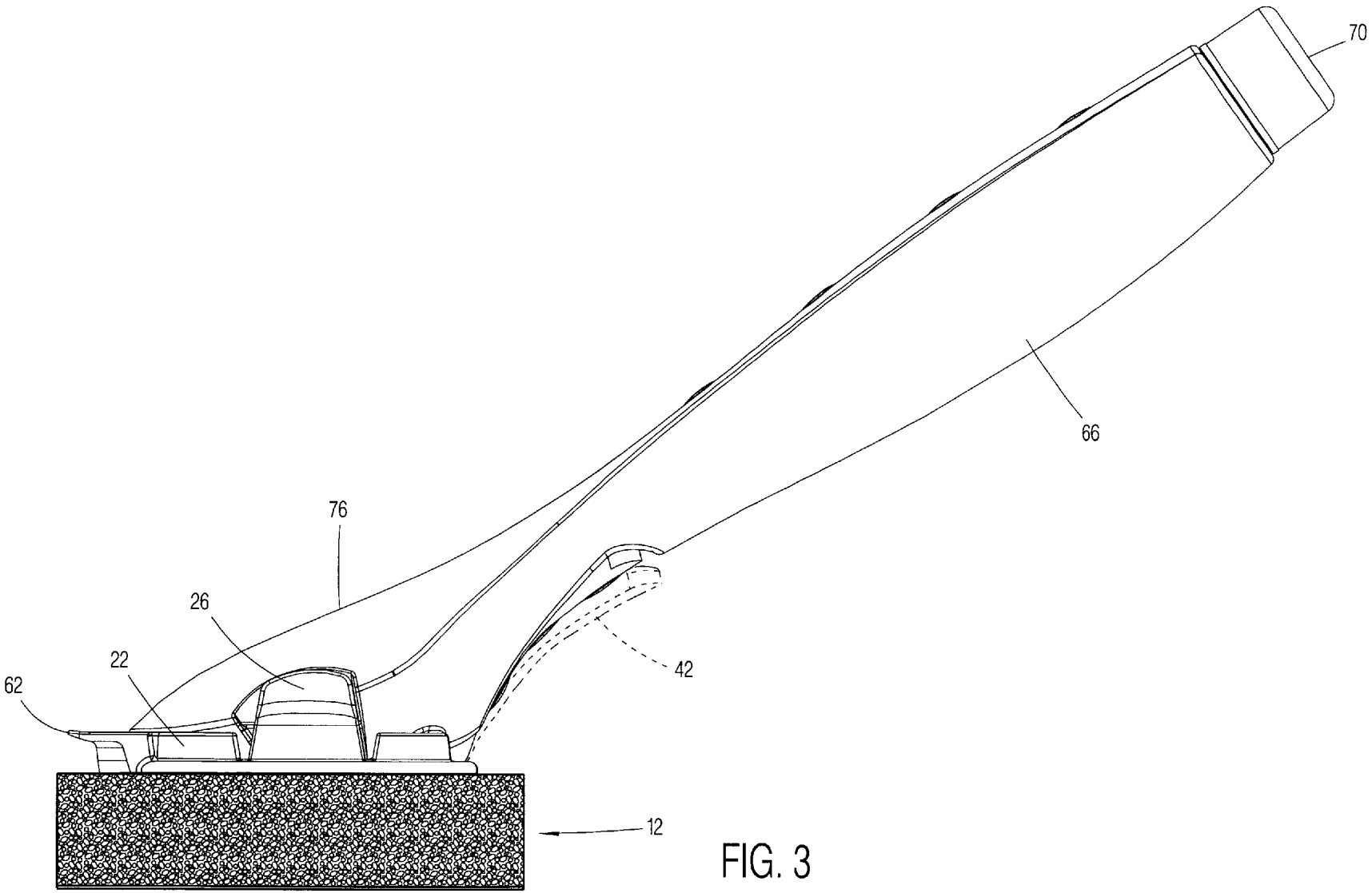
FIG. 3 is a side elevation view thereof; the opposite side being a mirror image.
Figure 4:
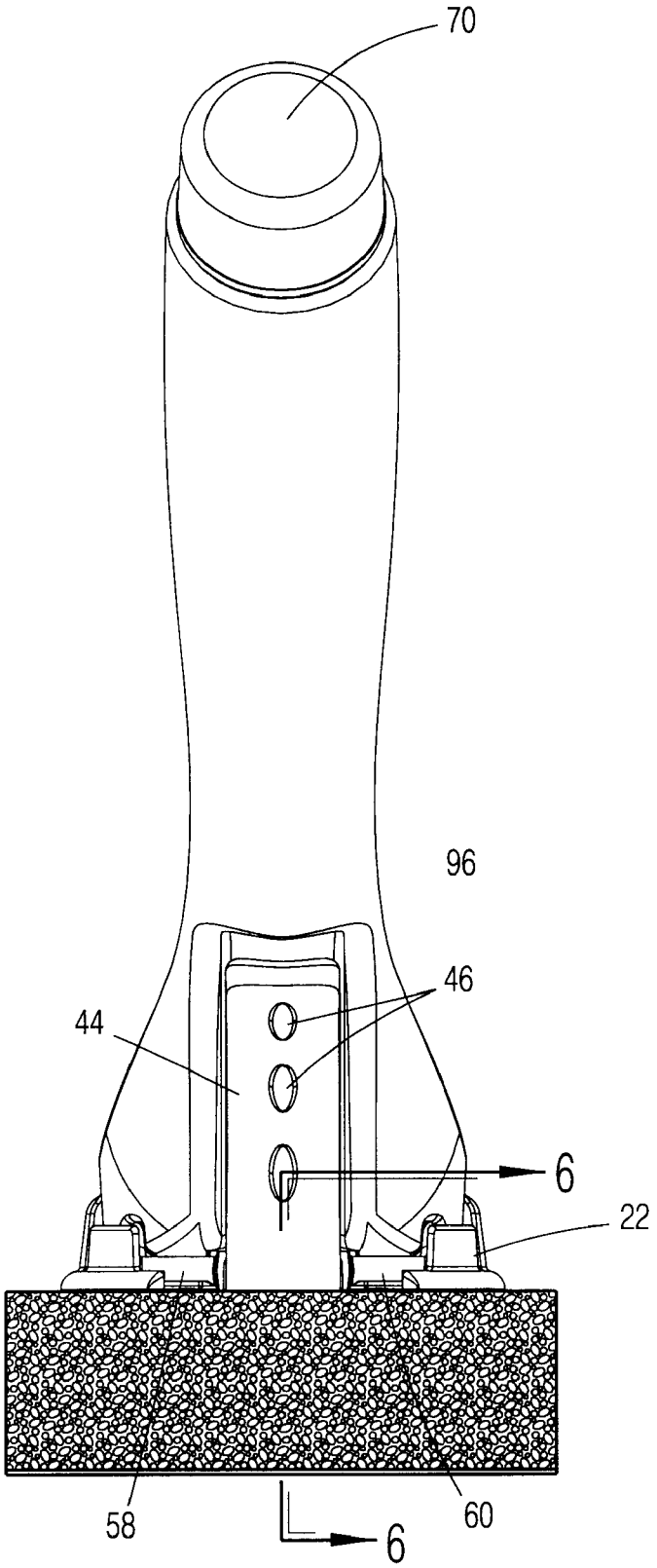
FIG. 4 is a rear elevation view thereof.

Referring initially to FIGS. 1 and 2, the subject dispensing applicator 10 is seen to comprise three basic components, namely: an applicator sponge 12, an applicator base plate 14, and a handle member 16. The handle 16 is formed of polyvinyl chloride resin by a blow molding process such that the body of handle 16 is of unitary construction. Moreover, as will be described below, the wall thickness of handle member 16 is relatively thin, on the order of 0.40 thousandths of an inch.

The base plate 14 is likewise of molded plastic, preferably injection molded high density polyethylene. Plate 14 has a thicker sectional dimension on the order of 0.80 thousandths of an inch relative to the blow molded handle member 16. The sponge member 12 is preferably formed of cellulose and polyester by conventional means.

Figure 5:
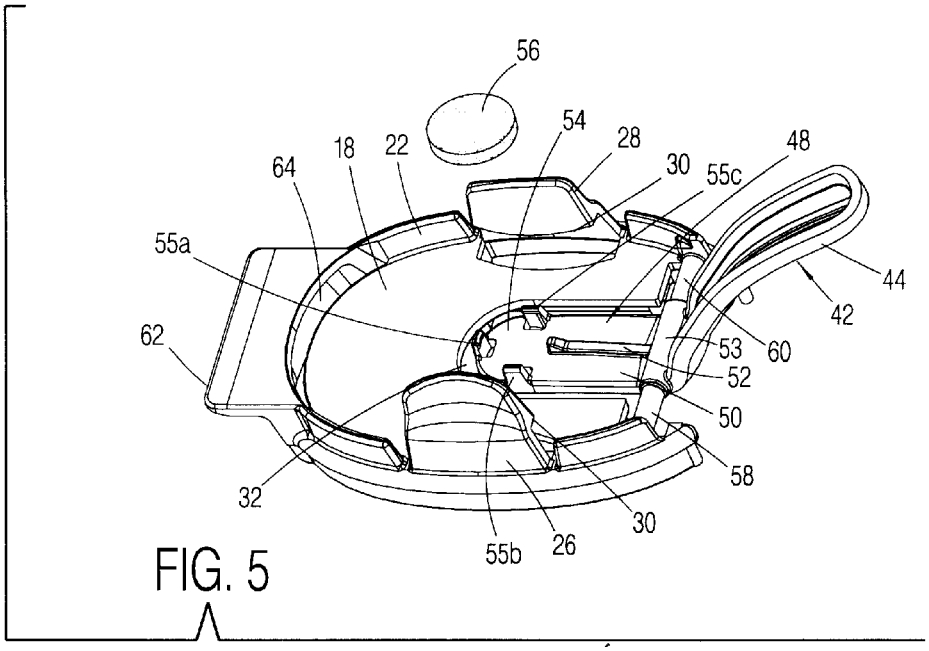
FIG. 5 is an exploded perspective view of the applicator attachment base plate and stopper pad.

As shown in FIGS. 2 and 5, the molded plastic applicator base plate 14 comprises a generally flat plate upper surface 18 of oval shape and a generally flat plate lower surface 20, likewise of oval configuration. An upwardly extending rim flange 22 extends about the perimeter of the plate upper surface 18. A lower skirt 24 extends the perimeter and depends downwardly from an outer edge of the plate lower surface 20.

A pair of locking tab projections 26, 28, integrally formed with the base plate 14, project upward in cantilever fashion from opposite sides of the plate upper surface 18. Each locking projection 26, 28 provides an inwardly facing sip surface 30. A U-shaped opening 32 extends through the base plate 14 from a rearward edge to a mid portion of the plate 14. Within the under side of the base plate 14 is a cavity 34 defined by the plate lower surface 20 and the dependent skirt 24. A matrix of intersecting reinforcement ribs 36 cross the cavity 34, with the lower edge of the ribs 36 being co-planar with a lower edge 40 of skirt 24.

An actuation lever 42 is integrally molded with the base plate 14, comprising a rearwardly disposed trigger arm 44. Digit-locating protrusions 46 are spaced along an underside of the trigger arm 44. At the forward end of the lever 42 is a closure arm 48 having an upper surface 50 along which a median reinforcement rib 52 extends. A fulcrum portion 53 is disposed between the arm 44 and the arm 48 such that the overall shape of the lever 42 is substantially V-shaped. An end portion 54 of the closure arm 48 is adapted to receive a stopper member 56. Three spaced apart locator flanges 55 a, b, and c are provided on the end portion 54 and define therebetween a cavity for receipt of the stopper member 56. Stopper member 56 is preferably composed of EPMD, and is affixed to end portion 54 by means of a suitable, commercially available adhesive.

A pair of torsion spring arms 58, 60 are integrally molded with the base plate 14. Outer ends of the torsion spring arms 58,60 are connected to the rim flange 22 and the arms 58, 60 extend inward to merge with the fulcrum portion 53 of the lever 42. Thus, the arms 58, 60 and the lever 42 are suspended between the rim flange 22 at a rearward portion of the base plate 14 with the forward closure arm 48 residing with clearance within opening 32 and the trigger arm 44 projecting rearward and upward (as viewed in FIG. 5) from the main body of the base plate 14. The trigger arm 44 is downwardly concave as formed.

Extending forward from the base plate 14 at a forward end is a transversely disposed scraper edge 62. The scraper edge 62 is intended for use in those cleaning applications, such as dishware cleaning, requiring an edge for use as a tool in the dislodgment of material.

Figure 6:
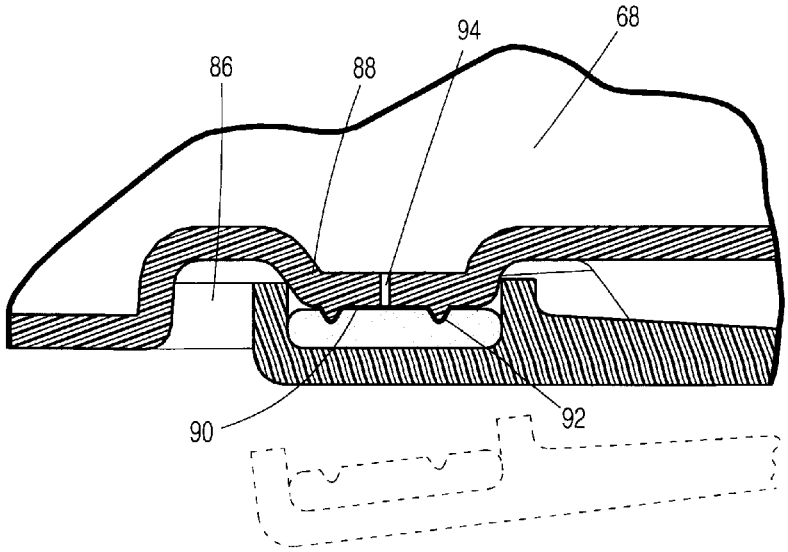
FIG. 6 is a partial section view through the handle taken along the line 6—6 of FIG. 4.

Referring next to FIGS. 1, 2, and 6, the handle 16 comprises a gripping portion 66 and an internal fluid reservoir 68. Reservoir 68 is formed during the blow molding process and is seamlessly defined by internal surfaces of the handle 16. A screw threaded end cap 70 is provided to attach by screw threads to a remote end of handle gripping portion 66, whereby closing off the fluid reservoir 68. Reservoir 68 is replenished by the removal of cap 70. A forward, oval shaped, nose portion 72 of the handle 16 is provided having a generally planar, downwardly facing, mounting surface 74 and a domed upper contoured surface 76. A nose flange 78 extends forward from the nose portion 72 in the manner shown. Disposed to extend into opposite sides of the nose portion 72 are a pair of locking depressions 80, 82, each depression providing a horizontal ledge 84 therein.

A cintrally disposed circular depression circular depression 86 extends into planar surface 74, and a central raised circular platform 88 resides within depression 86 terminating at a top surface 90. A circular shoulder 92, best viewed in FIG. 6. circumscribes top surface 90. A passageway 94 is molded to extend through the nose portion surface 74 and communicates with the internal reservoir 68.

The underside of the handle 16 is formed to have a concave, elongate depression 96 extending up the handle gripping portion 66; a spring receiving channel 98 extending into and across a rearward portion of the surface 74; and a rib-receiving channel 100 extending into surface 74, commencing at the spring receiving channel 98 and thence extending forward to the central depression 86.

From a combined consideration of FIGS. 1, 2, 5, and 6, it will be appreciated that manufacture and assembly of the subject applicator device is as follows. The sponge member 12 is independently formed of cellulose or polyester material. Alternative materials suitable for cleaning applications may be substituted. In addition, other applicator surfaces may be utilized within the scope of the present invention. For example, a plurality of brush bristles may be affixed to the underside of base plate 14 if so desired, or, without limitation, a polishing or cleaning cloth may be secured. In short, the application and the fluid to be applied to a surface or article will determine the configuration of the applicator side of the base plate 14.

The sponge 12, in the preferred embodiment, is attached by heat fusion to the base plate 14 underside, and resides within cavity 34, secured to lowermost edge 40 and the lower edges of reinforcement ribs 36. As explained previously, the base plate 14 is unitarily molded of conventional plastics material by conventional means, such as by injection molding. The base plate is formed in include an integral valve, represented by the actuation lever 42, the stopper 56, and the torsion springs 58, 60. The aforementioned components, which comprise the valve, are integrally formed with the body of the base plate 14 of the same material and by the same process.

As best seen in FIGS. 5 and 6, the stopper 56 is affixed by a suitable commercially available adhesive to the stopper end portion 54 of the lever closure arm 48, between protruding flanges 55*a, b*, and *c*. The base plate 14 attaches to the nose portion 72 of the handle 16. Nose flange 78 fits within opening 64 of the base plate 14 and is captured. Thereafter, surface 74 is moved downward between plate rim flange 22 and against surface 18. Aligned locking arms, or flanges, 26, 28, align with the depressions 80, 82, respectively, of nose portion 72 of handle 16 and the locking lip 30 of each rides over the locking ledge 84 within each depression 80, 82 to releasably attach the base plate 14 to the handle nose portion 72. The locking arms 28, 30, being formed as cantilevers of plastic material, resiliently flex outward to ride up and over the depression locking ledges 84 during attachment, and flex outward under manual influence to disengage the locking lip 30 from its respective ledge 84, whereby allowing the base plate 14 to separate from the handle nose portion 72.

In the attached position, the rib 52 of the lever 42 resides within channel 100 of the nose portion 72; the torsion springs 58, 60 and fulcrum portion 53 reside with the transverse channel 98; and lever trigger arm 44 resides within channel 96.

Moreover, in the attached position, the stopper 56 aligns opposite and seats within the depression 86 of the handle nose portion 72 and, therein, engages against the top surface 90. As the stopper 56 bears upon the circular shoulder 92 as shown in FIG. 6, it creates a liquid tight seal thereagainst, whereby blocking liquid from escaping from reservoir 68 by passage 94. The torsion spring members 58, 60 are in a quiescent, or unloaded, state when the stopper 56 in a closed relationship against surface 92. Resistance provided by the torsion spring members 58, 60 to loading acts to maintain the liquid tight seal between the stopper 56 and surface 90.

The load required to open the lever 42 is manually applied by digitally pressuring the trigger portion 44 toward handle 66, causing pivoting of the lever 42 about fulcrum 53 and lever arm 48 to pivot away from the handle nose portion 72. Such pivotal movement lifts the stopper 56 away from surface 90 and breaks the seal, allowing liquid to escape reservoir 68 through passageway 94. The escaping liquid flows downward about the lever arm 48, through U-shaped opening 32 in the base plate 14, and onto the back side of the sponge 12. From there it is distributed throughout the sponge and onto a surface against which the sponge 12 is pressed.

It will be noted that soap, or the liquid within handle 16, is dispensed at will by pressing the exposed rearward trigger portion 44 of the lever toward the handle 66. When the lever is pressed towards the handle, the opposite end of the lever 42, arm 48, moves away from the handle, exposing passageway 94 and allowing soap to leak into the sponge. Once the desired quantity of soap is dispensed, and the lever trigger portion 44 is released, the lever 42 will spring back to the closed position.

The load required to open the lever, and the automatic closing of the valve is caused by the two torsion springs 58, 60 located on either side of the lever fulcrum portion 53. The springs 58, 60 are substantially cylindrical, of circular cross-section. Outward ends of the spring members 58, 60 are integrally formed with sides of the base plate. Accordingly. the lever, torsion springs, and the base plate are a continuous, integrally formed piece of plastic.

The normal, quiescent state of the torsion springs is when the lever is in the closed position. When pivoted into the open position, the lever 42 causes the torsion springs 58, 60 to undergo a moment loading. Potential energy is stored in the torsion springs until the lever arm 44 is released, the energy is released to cause a reverse pivoting of the lever 42 and stopper 56 reassumes a sealing engagement against the nose portion of the arm.

The base plate 14 and sponge 12 can be sold separately as a replacement attachment. Because the scraper blade or edge 62 is an integral part of the replacement attachment, a new scraper is provided with each replacement. Additionally, the handle member 16 can be formed of thin wall construction because the thicker material needed for creation of the scraper blade 62 is provided by the base plate 14. Since base plate 14 is a physically smaller component than the handle member 16, positioning the blade 62 on the attachment applicator results in substantial material savings.

The base plate, from the foregoing, provides a combination of functional objectives. It acts as an applicator implement, supporting the sponge 12 or other applicator surface on one side for application purposes. Plate 14 further serves as a base plate for the scraper blade 62 which is integral therewith. Replacement of the applicator attachment automatically results in a replacement of the scraper element integral therewith.

Finally, the base plate 14 provides an integrally formed valve for selectively opening and closing the flow of liquid from the handle reservoir. Positioning the valve on the base plate member, as with the scraper, causes the valve element to be replaced each time the applicator attachment is replaced. This preventative replacement means the applicator will function as intended through prolonged use. Moreover, the valve is integrally formed with the base plate as a single body. The cost of manufacture is, resultingly, low and there is no additional assembly cost involved in assembling the valve to the applicator implement. Prior art devices which require assembly of the valve to the handle component not only introduce an additional component, increasing cost, but also add an additional assembly step which, again, results in an increased cost of manufacture.

While the above describes a preferred embodiment of the subject invention, the scope of the invention is not intended to be so restricted. Other uses of the teachings herein set forth are intended to be within the scope and spirit of the invention. By way of example, without any restriction being intended, the subject applicator may be adapted for use in non-cleaning applications. Liquid, other than fluid cleaning soap, may be stored within the reservoir and applied through the base plate 14 to other types of applicator elements for application to a surface. Liquid adhesives, or liquid wax, for example, may be so applied.

In addition, the base plate and integral valve taught herein have applications, which will be apparent to one skilled in the art, beyond the preferred use set forth. The valve and base plate, integrally formed, may be useful in may applications where controlled fluid flow from a reservoir is required. Beverage dispensers can be constructed having a similar valve arrangement as instructed herein without departing from the intended scope of the invention.

What is claimed is:

1. A cleaning liquid dispensing implement for dispensing a cleaning liquid, comprising:

a handle housing having an internal reservoir configured to store the cleaning liquid, and a discharge opening through the housing in communication with the reservoir through which said cleaning liquid is discharged;

an applicator member releasably affixed to said handle housing adjacent said discharge opening; said applicator member comprising a base plate and an applicator element disposed at one side of the base plate;

said applicator member further comprising a valve member mounted to said base plate for selectively opening and closing said discharge opening of said handle housing for dispensing the cleaning liquid; wherein said valve member includes an actuation member, a stopper member moveable by the actuation member between an open position away from the discharge opening and a closed position in sealing engagement with the handle housing discharge opening, and a biasing member for biasing the stopper member in the closed position;

wherein the actuation member includes a lever having a first arm, a second arm extending non-parallel to the first arm, and a fulcrum portion disposed between the first arm and the second arm, and the fulcrum portion is pivotally attached to a lever support portion of the applicator member base plate.

2. The cleaning liquid dispensing implement according to claim 1, wherein said stopper member is attached to a remote end of said lever first arm.

3. The cleaning liquid dispensing implement according to claim 2, wherein said second lever arm pivots toward and away from said handle housing, whereby moving said stopper member between said closed and said open positions.

4. The cleaning liquid dispensing implement according to claim 3, wherein said lever support portion of said applicator base plate comprises a torsion spring.

5. The cleaning liquid dispensing implement according to claim 4, wherein said biasing member comprises said torsion spring.

6. The cleaning liquid dispensing implement according to claim 4, wherein said torsion spring comprises a transversely extending arm supporting said lever fulcrum portion.

7. The cleaning liquid dispensing implement according to claim 6, wherein said actuation member together with said biasing member and said applicator base plate being formed as an integral one-piece unit.

8. The cleaning liquid dispensing implement according to claim 7, wherein said base plate further comprising an integrally formed scraper portion at a forward end.

9. The cleaning liquid dispensing implement according to claim 1, wherein said actuation member together with said biasing member and said applicator base plate being formed as a one piece unit.

10. The cleaning liquid dispensing implement according to claim 9, wherein said base plate further comprising an integrally formed scraper portion at a forward end.

11. The cleaning liquid dispensing implement according to claim 1 wherein the base plate includes a pair of projection configured to releasably affix the applicator member to the handle housing.

12. The cleaning liquid dispensing implement according to claim 1 wherein said biasing member includes a torsion spring that merges with the fulcrum portion.

13. The cleaning liquid dispensing applicator for dispensing a cleaning liquid and of the type comprising a base plate member releasably attachable to a handle housing and an applicator element disposed at one side of the base plate, the improvement comprising:

a valve member mounted to said base plate for selectively opening and closing a discharge opening in said handle housing for dispensing the cleaning liquid, the valve member including an actuation member, a stopper member moveable by the actuation member between an open position away from the discharge opening, and a biasing member for biasing the stopper member in the closed position;

wherein the actuation member including a lever having a first arm, a second arm extending non-parallel to the first arm, and a fulcrum portion disposed between the first arm and the second arm, and the fulcrum portion is pivotally attached to a lever support portion of the applicator base plate.

14. The cleaning liquid dispensing applicator as set forth in claim 13, said valve member and said base plate being formed as an integral one piece unit.

15. The cleaning liquid dispensing applicator as set forth in claim 14, wherein said base plate further comprising an integrally formed scraper portion at a forward end.

16. The cleaning liquid dispensing applicator according to claim 13, wherein said stopper member is attached to a remote end of said lever first arm.

17. The cleaning liquid dispensing applicator according to claim 16, wherein said second lever arm pivots toward and away from said handle housing, whereby moving said stopper member between said closed and said open positions.

18. The cleaning liquid dispensing applicator according to claim 17, wherein said lever support portion of said applicator base plate comprises a torsion spring.

19. The cleaning liquid dispensing applicator according to claim 18, wherein said biasing member comprises said torsion spring.

20. The cleaning liquid dispensing applicator according to claim 19, wherein said torsion spring comprises a transversely extending torsion arm integrally formed with the base plate member at opposite first and second ends and supporting said lever fulcrum portion at a mid-portion between said first and second torsion arm ends.

21. The cleaning liquid dispensing applicator according to claim 13, wherein said actuation member together with said biasing member and said applicator base plate being formed as an integral one-piece unit.

22. The cleaning liquid dispensing applicator according to claim 21, wherein said base plate further comprising an integrally formed scraper portion at a forward end.

23. A cleaning liquid dispensing handle for dispensing a cleaning liquid, comprising:

a handle housing having an internal reservoir for storing the cleaning liquid and a discharge opening through the housing which is in communication with the reservoir and through which the cleaning liquid is discharged;

an applicator member releasably affixed to the handle housing adjacent the discharge opening, the applicator member including a base plate, a sponge disposed at one side of the base plate, and a valve member mounted to the base plate for selectively opening and closing the discharge opening of the handle housing for dispensing the cleaning liquid;

wherein the valve member comprises an actuation member, a stopper member moveable by the actuation member between an open position away from the discharge opening and a closed position in sealing engagement with the handle housing-discharge opening, and a biasing member for biasing the stopper member in the closed position;

wherein the actuation member comprising a lever, the lever comprising a first arm, a second arm extending non-parallel to the first arm, and a fulcrum portion disposed between the first arm and the second arm, and the fulcrum portion is pivotally attached to a lever support portion of the applicator member base plate.

24. A cleaning liquid dispensing handle for dispensing a cleaning liquid, comprising:

a handle housing having an internal reservoir for storing the cleaning liquid and a discharge opening through the housing which is in communication with the reservoir and through which the cleaning liquid is discharged;

an applicator member releasably affixed to the handle housing adjacent the discharge opening, the applicator member including a base plate, a sponge disposed at one side of the base plate, and a valve member mounted to the base plate for selectively opening and closing the discharge opening of the handle housing for dispensing the cleaning liquid;

wherein the valve member comprises an actuation member, a stopper member moveable by the actuation member between an open position away from the discharge opening and a closed position in sealing engagement with the handle housing-discharge opening, and a biasing member for biasing the stopper member in the closed position;

wherein the actuation member comprising a lever, the lever comprising a first arm, a second arm extending non-parallel to the first arm, and a fulcrum portion disposed between the first arm and the second arm, and the fulcrum portion is pivotally attached to a lever support portion of the applicator member base plate;

wherein the biasing member includes a torsion spring that merges with the fulcrum portion.

25. An applicator implement for dispensing a liquid, comprising:

a handle housing having an internal reservoir configured to store the liquid, and a discharge opening through the housing in communication with the reservoir through which the liquid is discharged;

an applicator member releasably affixed to the handle housing adjacent the discharge opening; the applicator member comprising a base plate and an applicator element disposed at one side of the base plate;

the applicator member further comprising a valve member mounted to the base plate for selectively opening and closing the discharge opening of the handle housing for dispensing the liquid, wherein the valve member comprises an actuation member, a stopper member moveable by the actuation member between an open position away from the discharge opening and a closed position in sealing engagement with the handle housing discharge opening, and a biasing member for biasing the stopper member in the closed position;

wherein the actuation member comprising a lever, the lever comprising a first arm, a second arm extending non-parallel to the first arm, and a fulcrum portion disposed between the first arm and the second arm, and the fulcrum portion is pivotally attached to a lever support portion of the applicator member base plate.

26. The applicator implement according to claim 25, wherein the valve member comprises an actuation member, a stopper member moveable by the actuation member between an open position away from the discharge opening and a closed position in sealing engagement with the handle housing discharge opening; and a biasing member for biasing the stopper member in the closed position.

27. The applicator implement according to claim 26, wherein the actuation member comprising a lever, the lever comprising a first arm, a second arm extending non-parallel to the first arm, and a fulcrum portion disposed between the first arm and the second arm, and the fulcrum portion is pivotally attached to a lever support portion of the applicator member base plate.

28. The applicator implement according to claim 27, wherein the stopper member is attached to a remote end of the lever first arm.

29. The applicator implement according to claim 28, wherein the second lever arm pivots toward and away from the handle housing, whereby moving the stopper member between the closed and the open positions.

30. The applicator implement according to claim 29, wherein the lever support portion of the applicator base plate comprises a torsion spring.

31. The applicator implement according to claim 30, wherein the biasing member comprises the torsion spring.

* * * * *